United States Patent [19]

Williams

[11] 4,144,718

[45] Mar. 20, 1979

[54] REFRIGERATION SYSTEM

[76] Inventor: Alea Williams, 1930 Asbury, Evanston, Ill. 60201

[21] Appl. No.: 780,777

[22] Filed: Mar. 24, 1977

[51] Int. Cl.[2] ..... F25D 17/02

[52] U.S. Cl. ..... 62/180; 62/98; 62/394

[58] Field of Search ..... 62/98, 180, 392, 399, 62/394

[56] References Cited

U.S. PATENT DOCUMENTS

| | | | |
|---|---|---|---|
| 2,471,137 | 5/1949 | Atchison | 62/227 X |
| 2,511,582 | 6/1950 | Grindrod | 62/394 X |
| 2,762,209 | 9/1956 | Bennett | 62/394 X |
| 3,280,592 | 10/1966 | Barday | 62/399 |

*Primary Examiner*—William E. Wayner

*Attorney, Agent, or Firm*—Tilton, Fallon, Lungmus & Chestnut

[57] ABSTRACT

An improved refrigeration system for chilling a circulating water supply for reuse in cooling industrial equipment. The system includes a water container having therein a coiled refrigerant tube and a coiled water tube. The coiled refrigerant tube has a plurality of turns normally positioned below the level of water in the container with the coiled water tube being generally positioned within the coiled refrigerant tube in coaxial relationship. Water inlet means is provided adjacent one end of the coiled water tube through which water from the industrial equipment may flow into the water tube and water outlet means is provided adjacent the other end of the coiled water tube from which water from the water tube may flow into the container. Refrigerant inlet means is provided adjacent one end of the coiled refrigerant tube through which refrigerant from a condenser may flow into the refrigerant tube and refrigerant outlet means is provided adjacent the other end of the coiled refrigerant tube through which refrigerant from the refrigerant tube may flow into a compressor. The system also includes a refrigerant recirculation tube and first and second water recirculation tubes interconnected to pump means for circulating water to and from the industrial equipment. With these features of construction, the improved refrigeration system can chill a circulating water supply for reuse in cooling industrial equipment.

3 Claims, 1 Drawing Figure

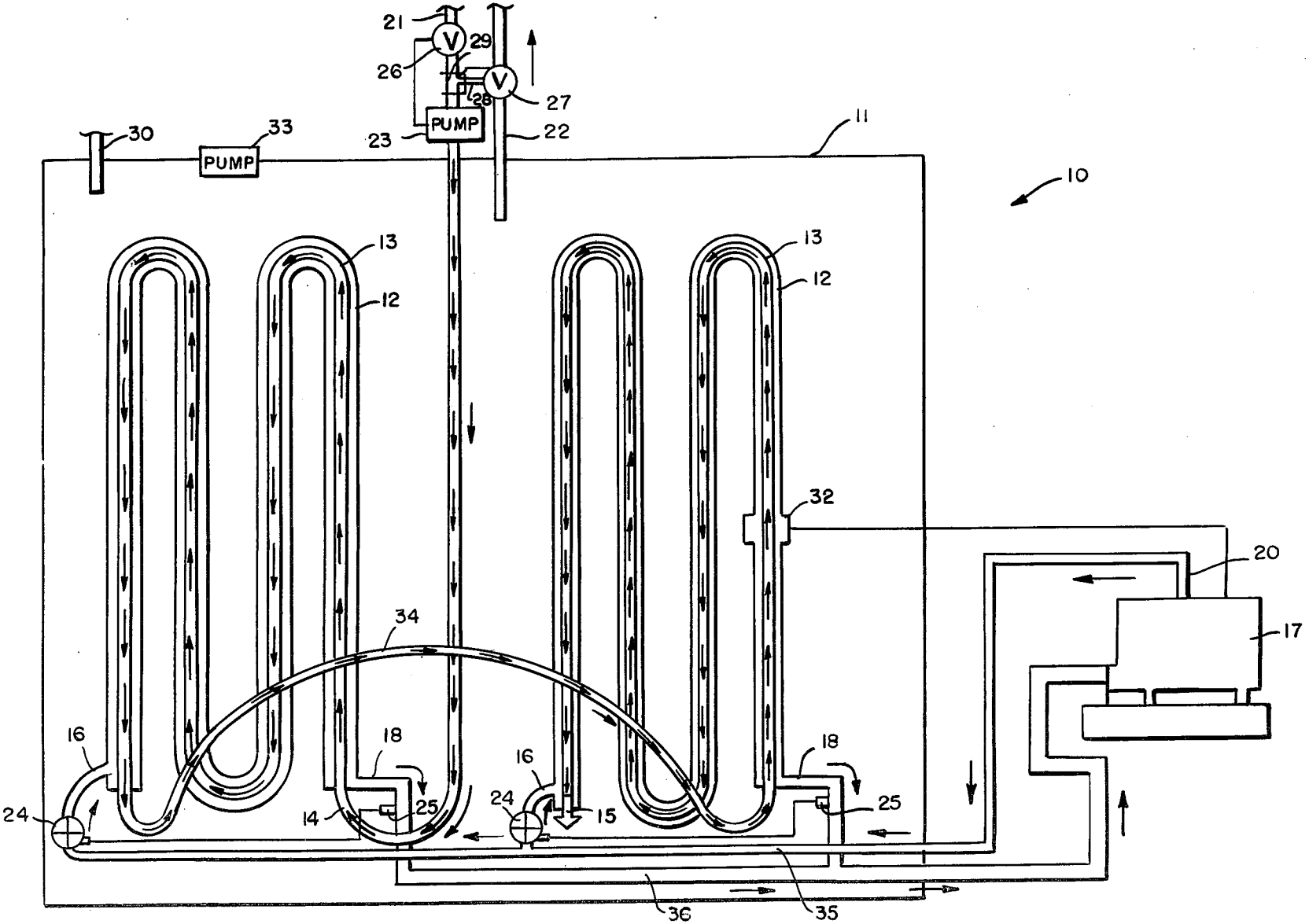
10
11
12
13
14
15
16
17
18
20
21
22
23
24
25
26
27
28
29
30
32
33
34
35
36
PUMP
PUMP

REFRIGERATION SYSTEM

BACKGROUND

This invention relates to an improved refrigeration system and, more particularly, to a system for chilling a circulating water supply for reuse in cooling industrial equipment.

Water chillers are useful for chilling a circulating water supply for reuse in cooling industrial equipment. The uses for such equipment are many including many typical applications such as injection blow molding, extruding, printing and etching, controlled chemical processing, controlled food processing, and industrial machine cooling. It has been found, for instance, that use of a water chiller with many industrial machines, such as hydraulic presses, compressors, metal treating ovens, and special metal fabrication processes results in definite improvements in operating efficiency. The advantages of using such equipment have been readily apparent to those skilled in the art even though such equipment has previously not been fully developed to the desired extent. With the water chillers heretofore available, it has been necessary to utilize complex refrigeration equipment of large capacity using significant amounts of energy even then oftentimes failing to achieve a fully satisfactory temperature drop in the circulating water supply.

With respect to most prior water chillers, the refrigeration systems have usually been conventional designs of types commonly available for many years. The coiled refrigerant tubes or evaporators are simply emersed in a container of water to chill the water used to cool the equipment. It is significant to note that such systems continuously introduce or mix hot water coming from the equipment to be chilled with partially chilled water being withdrawn for recirculation to the equipment. The coiled refrigerant tubes or evaporators are therefore impeded in achieving the desired temperature drop in the water by reason of the constant intermixing of hot water with the partially chilled water. While this problem has long existed, water chillers heretofore available have simply not been successful in overcoming it.

While those skilled in the art of water chillers may have long been aware of the problem, the development of satisfactory equipment has not followed. In the field, refrigeration systems have more recently become more sophisticated such as those disclosed in U.S. Pat. Nos. 3,435,627, 3,310,103 and 3,180,108 wherein the systems disclosed represent attempted improvements of limited success. While those skilled in the art may have actively sought to overcome the problem, I have provided an improved refrigeration system that for the first time represents a significant advance fully overcoming the problems inherent in prior water chillers.

SUMMARY

The present invention is directed to an improved refrigeration system for chilling a circulating water supply for reuse in cooling industrial equipment. The system includes a water container having therein a coiled refrigerant tube and a coiled water tube. The coiled refrigerant tube has a plurality of turns normally positioned below the level of water in the container with the coiled water tube being generally positioned within the coiled refrigerant tube in coaxial relationship. Water inlet means is provided adjacent one end of the coiled water tube through which water from the industrial equipment may flow into the water tube and water outlet means is provided adjacent the other end of the coiled water tube from which water from the water tube may flow into the container. Refrigerant inlet means is provided adjacent one end of the coiled refrigerant tube through which refrigerant material from a condenser may flow into the refrigerant tube and refrigerant outlet means is provided adjacent the other end of the coiled refrigerant tube from which refrigerant material from the refrigerant tube may flow into a compressor. The coiled refrigerant tube and the coiled water tube are constructed of a material having a high thermal conductivity value with the water tube having a substantially smaller diameter than the diameter of the refrigerant tube. The system also includes a refrigerant recirculation tube and first and second water recirculation tubes interconnected to pump means for circulating water to and from the industrial equipment. With these features of construction, an improved refrigeration system is provided for chilling a circulating water supply for reuse in cooling industrial equipment.

In a preferred embodiment of my refrigeration system, the refrigerant inlet means is a refrigerant inlet tube communicating with the one end of the coiled refrigerant tube and the refrigerant outlet means is a refrigerant outlet tube communicating with the other end of the coiled refrigerant tube. A thermostatically responsive expansion valve is provided in the refrigerant inlet means or tube having sensing means responsive to the temperature of the refrigerant as it flows through the refrigerant outlet means or tube, the expansion valve opening at a first preselected temperature and closing at a second preselected temperature lower than the first preselected temperature, the sensing means being a thermocouple controlling the opening and closing of the expansion valve in response to temperature changes in the refrigerant at the refrigerant outlet means or tube. The water inlet means is a water inlet tube communicating with the one end of the coiled water tube and the water outlet means is an opening in the other end of the coiled water tube through which water may flow into the container.

The first water recirculating tube upstream of the pump means preferably includes a flow valve switch. The flow valve switch is adapted to stop the pump means in response to the rate of flow of the water dropping below a preselected flow rate. The second water recirculation tube between the flow valve switch and the pump means preferably includes a thermostatically responsive diverter valve.

The diverter valve is connected to the water recirculation tube upstream of the pump means through a diverter tube. The diverter valve opens and closes in response to the temperature in the water as it flows through the first water recirculation tube rising above and falling below a preselected temperature. The diverter valve in the open position causes at least a portion of the water flowing from the container to the industrial equipment to be diverted through the diverter tube from the second water recirculation tube to the first water recirculation tube to cool the water flowing from the industrial equipment prior to entering the coiled water tube and in the closed position causes all of the water flowing from the container to flow to the industrial equipment through the second water recirculation tube. The diverter valve has sensing means responsive to the temperature of the water as it flows through the first water recirculation tube to open and close the diverter valve. The sensing means is a thermocouple controlling the opening and closing of the diverter valve.

The container also includes overflow control means. The overflow control means is an overflow tube through the container preferably at a level just above the first water recirculation tube. The pump means also is an electrically driven centrifugal pump.

The refrigeration system further includes a switch responsive to refrigerant pressure between the compressor and the expansion valve on the high pressure side of the system to shut down the compressor at a preselected maximum pressure. It still further includes a switch responsive to refrigerant temperature in the coiled refrigerant tube between the expansion valve and the compressor to shut down the compressor at a preselected minimum temperature. The refrigeration system further includes a switch response to refrigerant pressure between the expansion valve and the compressor on the low pressure side of the system to shut down the compressor at a preselected minimum pressure.

The present invention retains the advantages inherent in water chillers while at the same time providing an improved refrigeration system that enhances the desirability of such chillers. It is therefore an object of the present invention to provide an improved refrigeration system for chilling a circulating water supply for reuse in cooling industrial equipment which is highly effective in operation while at the same time being relatively inexpensive to manufacture and install. The provision of the structure and the realization of the advantages to be derived therefrom constitute additional important objects of the present invention with still other objects to be appreciated from a consideration of the details of construction and operation set forth in the accompanying specification, claims and drawing.

DRAWING

The invention is described in conjunction with the accompanying drawing in which a schematic view is presented illustrating the features of the improved refrigeration system of the present invention.

DESCRIPTION

In the illustration given and with reference to the drawing, the numeral 10 designates generally an improved refrigeration system for chilling a circulating water supply for reuse in cooling industrial equipment (not shown) in accordance with the present invention. The refrigeration system 10 includes a water container 11 having therein a coiled refrigerant tube 12 adapted to receive a circulating refrigerant material and a coiled water tube 13 adapted to receive the circulating water supply. The coiled refrigerant tube 12 has a plurality of turns and is normally positioned below the level of water in the container 11 with the coiled water tube 13 being generally positioned within the refrigerant tube 12 in coaxial relationship. Water inlet means 14 is provided adjacent one end of the coiled water tube 13 through which water from the industrial equipment (not shown) may flow into the water tube 13 and water outlet means 15 is provided adjacent the other end of the coiled water tube 13 from which water from the water tube 13 may flow into the container 11. Refrigerant inlet means 16 is provided adjacent one end of the coiled refrigerant tube 12 through which refrigerant material from a condenser (not shown) within a housing 17 may flow into the refrigerant tube 12 and refrigerant outlet means 18 is provided adjacent the other end of the coiled refrigerant tube 12 from which refrigerant material may flow from the refrigerant tube 12 to a compressor (not shown) within the housing 17. The coiled refrigerant tube 12 and the coiled water tube 13 are constructed of a material having a high thermal conductivity value with the water tube 13 having a substantially smaller diameter than the diameter of the refrigerant tube 12. The refrigeration system 10 also includes a refrigerant recirculation tube 20 adapted to receive vaporized refrigerant material from the compressor and to carry the vaporized refrigerant material to the condenser, a first water recirculation tube 21 leading from the industrial equipment to the water inlet means 14, a second water recirculation tube 22 leading from the container 11 to the industrial equipment, and pump means 23 associated with the water recirculation tubes 21 and 22 for circulating water from the industrial equipment through the refrigeration system 10 and again to the industrial equipment. With these features of construction, the improved refrigeration system 10 is well suited for chilling a circulating water supply for reuse in cooling industrial equipment.

The refrigerant inlet means 16 is a refrigerant inlet tube communicating with the one end of the coiled refrigerant tube 12 and the refrigerant outlet means 18 is a refrigerant outlet tube communicating with the other end of the coiled refrigerant tube 12. A thermostatically responsive expansion valve 24 is provided in the refrigerant inlet means or tube 12 having sensing means 25 responsive to the temperature of the refrigerant as it flows through the refrigerant outlet means or tube 18, the expansion valve 24 opening at a first preselected temperature and closing at a second preselected temperature lower than the first preselected temperature, the sending means 25 being a thermocouple controlling the opening and closing of the expansion valve 24 in response to temperature changes in the refrigerant at the refrigerant outlet means or tube 18. The water inlet means 14 is a water inlet tube communicating with the one end of the coiled water tube 13 and the water outlet means 14 is an opening in the other end of the coiled water tube 13 through which water may flow into the container 11.

The first water recirculation tube 21 upstream of the pump means 23 includes a flow valve switch 26. The flow valve switch 26 is adapted to stop pump means 23 in response to the rate of flow of the water dropping below a preselected flow rate. The second water recirculation tube 22 includes a thermostatically responsive diverter valve 27.

The diverter valve 27 is connected to the first water recirculation tube 21 upstream of the pump means 23 through a diverter tube 28. The diverter valve 27 opens and closes in response to the temperature in the water as its flows through the first water recirculation tube 21 rising above and falling below a preselected temperature. The diverter valve 27 in the open position causes at least a portion of the water flowing from the container 11 to the industrial equipment (not shown) to be diverted through the diverter tube 28 from the second water recirculation tube 22 to cool the water flowing from the industrial equipment prior to entering the coiled water tube 13 and in the closed position causes all of the water flowing from the container 11 to flow to the industrial equipment through the second water recirculation tube 22. The diverter valve 27 has sensing means 29 responsive to the temperature of the water as it flows through the first water recirculation tube 21 to open and close the diverter valve 27. The sensing means 29 is a thermocouple controlling the opening and closing of the diverter valve 27.

The container 11 also includes overflow control means 30. The overflow control means 30 is an overflow tube through the container 11 preferably at a level just above the second water recirculation tube 22. The pump means 23 can be an electrically driven centrifugal pump.

The refrigeration system 10 further includes a switch (not shown) within the housing 17 responsive to refrigerant pressure between the compressor and the expansion valve 24 on the high pressure side of the system to shut down the compressor at a preselected maximum refrigerant pressure. It also includes a switch 32 responsive to refrigerant temperature in the coiled refrigerant tube 12 located downstream of the expansion valve 24 and upstream of the compressor to shut down the compressor at a preselected minimum refrigerant temperature. The refrigeration system 10 further includes a switch (not shown) within the housing 17 responsive to refrigerant pressure between the expansion valve 24 and the compressor on the low pressure side of the system to shut down the compressor at a preselected minimum refrigerant pressure.

The coiled refrigerant tube 12 and the coiled water tube 13 are preferably constructed of copper. The ratio of the inner diameter of the coiled refrigerant tube 12 to the inner diameter of the coiled water tube 13 is on the order of 2:1. The refrigerant is preferably selected from the Freon family.

While the capacities of the refrigeration system 10 are clearly matters of choice depending upon the particular application, I have found certain ranges of capacities to be desirable for the purposes described. It has been found that water received from the industrial equipment will oftentimes require a temperature drop of between 10° and 15° F. in order to achieve and maintain steady state operating conditions. The refrigeration system will then normally have a capacity of between 1 and 20 tons using a $\frac{1}{4}$ to $1\frac{1}{2}$ horsepower pump having a capacity of 200 to 4000 gallons per hour. Additionally, I have found that it is possible for the refrigerant to be carried through the coiled refrigerant tube 12 either in the same direction or in the opposite direction of the flow of water through the coiled water tube 13 with the directions indicated on the drawing being presented merely for purposes of illustration. The refrigeration system can also advantageously utilize an agitator pump 33 in the container 11 to further increase the efficiency of the system in achieving the temperature drop in the water. It has been found that the diameter of the coiled refrigerant tube under these conditions should be in the range of between $\frac{3}{8}''$ and $\frac{5}{8}''$ with the coiled water tube having a diameter of between $\frac{3}{4}''$ and $1\frac{1}{4}''$. With these features of construction, the refrigeration system 10 can chill a circulating water supply for reuse in cooling industrial equipment in a highly efficient and effective manner.

Referring to the drawing, the operation of the refrigeration system 10 can be understood. The circulating water supply is carried from the industrial equipment in the first water recirculation tube 21 through the flow valve switch 26 and the sensing means 29 by means of the electrically driven centrifugal pump 23. The pump 23 forces the circulating water supply along the first water recirculation tube 21, through the water inlet means or tube 14, and into the coiled water tube 13. It will be seen that the circulating water supply flows through one coiled water tube 13 after which it passes through a water connector tube 34 connecting the one coiled water tube 13 to another coiled water tube 13 and then the circulating water supply flows through the other coiled water tube 13. The pump 23 eventually forces the circulating water supply through the water outlet means or opening 15 in the coiled water tube into the container 11. The circulating water supply in the container 11 is then agitated by the agitator pump 33 and drawn off in the second water recirculation tube 22 by pump means (not shown) passing through the diverter valve 27 for reuse in cooling the industrial equipment.

The circulating refrigerant passes from the compressor through the refrigerant recirculation tube 20 and the condenser as a vapor at high pressure. Heat is given off at a high pressure in the condenser after which the refrigerant passes through a refrigerant supply tube 35 to the expansion valves 24 associated with the one coiled refrigerant tube 12 and another coiled refrigerant tube 12 as liquid under high pressure. Pressure is significantly reduced by the expansion valves 24 after which the refrigerant passes through the refrigerant inlet means or tubes 16 into the one coiled refrigerant tube 12 and the other refrigerant tube 12 where the refrigerant evaporates at low pressure. Heat is absorbed at a low pressure in the one coiled refrigerant tube 12 and the other coiled refrigerant tube 12 causing the water temperature to lower after which the refrigerant is drawn away through the refrigerant outlet means or tubes 18 and a refrigerant return tube 36 by the compressor as vapor at low pressure. With these features of construction, the circulating refrigerant has a significantly increased surface area of the coiled refrigerant tubes 12 per unit volume of refrigerant exposed to the circulating water supply thereby greatly enhancing the cooling ability of the refrigerant.

Referring again to the drawing, the circulating water supply carried from the industrial equipment in the first water recirculation tube 21 passes through the flow valve switch 26 and the sensing means 29 by means of the operation of the pump 23. The flow valve switch 26 permits the pump 23 as well as the agitator pump 33 to operate so long as there is a sufficient supply of water being returned from the industrial equipment. It will stop the pumps 23 and 33, however, in the event that the rate of flow of the water drops below a preselected flow rate thereby protecting the pumps from damage which might otherwise be caused by overheating or the like. The sensing means 29 will permit the water from the container 11 to be carried to the industrial equipment unimpaired through the diverter valve 27 and the second water recirculation tube 22 in the event that the temperature in the water carried in the first water recirculation tube 21 rises above a preselected temperature. The diverter valve 27 will then open to cause chilled water to be diverted from the second water recirculation tube 22 through the diverter valve 27, diverter tube 28, and sensing means 29 into the first water recirculation tube 21. With these features of construction, it is possible to assure that the water carried from the industrial equipment in the first water recirculation tube 21 will always be at or below a preselected temperature to avoid overworking the refrigeration system 10.

While the diverter valve 27, the diverter tube 28, and sensing means 29 are useful to avoid overworking the refrigeration system 10, they are also useful to assure that the circulating water supply carried in the second water recirculation tube 22 to the industrial equipment will always be at or below a preselected temperature. The water carried in the first water recirculation tube 21 always being at or below a preselected temperature assures that the coiled refrigerant tubes 12 can produce an adequate temperature drop in the circulating water supply as the water passes through the coiled water tubes 13 and the container 11. It will be appreciated that this capability is greatly enhanced by the double exposure of the water to the coiled refrigerant tubes 12, i.e., both as the water passes through the coiled water tube 13 and as it is temporarily held in the container 11. The water chilling is further enhanced by the fact that the warmest water first passes through the chilled water tubes 13 inside of the coiled refrigerant tubes 12 being cooled down substantially before even flowing into the container 11 in marked contrast to prior art systems in which hot water is dumped directly into the partially cooled water in a container having standard coiled refrigerant tubes.

With reference to the use of two sets of coiled refrigerant tubes 12 and coiled water tubes 13, it will be appreciated that this has been provided merely for purposes of illustration. The exact number of sets of such coiled tubes can vary from one upward depending upon the cooling requirements and size constraints for a particular application. One feature I have found particularly advantageous, however, is to provide a separate expansion valve 24, refrigerant inlet means or tube 16, and refrigerant outlet means or tube 18 with each of the coiled refrigerant tubes 12 wherein the refrigerant supply tube 35 communicates with each of the expansion valves 24 and the refrigerant return tube 36 communicates with each of the refrigerant outlet means or tubes 18. It will be seen that the coiled water tubes 13 are then successively in communication through the water connector tube 34 so that the entire circulating water supply flows through the coiled water tubes 13 associated with each of the coiled refrigerant tubes 12. With these features of construction, a series of independent coiled refrigerant tubes 12 can be used with a continuous circulating water supply flowing through the coiled water tube 13 within each of them to assure that the water is adequately chilled before flowing through the opening 15 at the remote end of the last of the coiled water tubes 13 into the container 11.

Of course, the expansion valves 24 associated with each of the coiled refrigerant tubes 12 include thermocouple sensing means 25 responsive to the temperature of the refrigerant as it flows through corresponding refrigerant outlet means or tubes 18 with the expansion valves 24 opening at a first preselected temperature and closing at a second preselected temperature lower than the first preselected temperature. This helps to assure that the temperature of the refrigerant flowing through the coiled refrigerant tubes 12 is always maintained between desired limits. As a result, the amount of refrigerant flowing is governed by the expansion valves 24 and at the same time they assure that the circulating water supply is adequately chilled. This is also accomplished by means of the switches responsive to refrigerant temperature and pressure to shut down the compressor at a preselected minimum temperature and pressure. Another advantageous feature is the switch responsive to refrigerant pressure to shut down the compressor at a preselected maximum pressure. This assures against overheating of the refrigeration system 10 that might cause severe damage to the compressor, condenser, and expansion valves 24 as well as to the industrial equipment to be cooled. Accordingly, the refrigeration system 10 has numerous built-in safety features not heretofore available in a combination of the type described.

The present invention therefore retains the advantages inherent in water chillers while at the same time overcoming the disadvantages in such systems with a unique combination and arrangement of elements. It will be appreciated that I have provided a significantly improved refrigeration system for chilling a circulating water supply for reuse in cooling industrial equipment in a highly efficient and effective manner. The present invention therefore successfully achieves all of the stated goals and objectives of my invention.

While in the foregoing specification a detailed description of the invention has been set forth for purposes of illustration, the details herein given may be varied by those skilled in the art without departing from the spirit and scope of the invention.

I claim:

1. A refrigeration system for chilling a circulating water supply for reuse in cooling industrial equipment, wherein the improvement comprises a water container, two coiled refrigerant tubes disposed within said container below the normal water level therein, said refrigerant tubes each having refrigerant inlet means at one end thereof for receiving refrigerant from a condenser and each having refrigerant outlet means at the opposite end thereof for discharging the refrigerant to a compressor, a first coiled water tube coaxially disposed within one of said coiled refrigerant tubes, said first water tube having water inlet means adjacent the refrigerant outlet means for said one refrigerant tube and having water outlet means adjacent the refrigerant inlet means for said one refrigerant tube, a second coiled water tube coaxially disposed within the other of said refrigerant tubes, said second water tube having water inlet means adjacent the refrigerant outlet means for said other refrigerant tube and having water outlet means adjacent the refrigerant inlet means for said other refrigerant tube, said first and second water tubes being arranged in series with said outlet means of said first water tube being operatively connected to the inlet means of said second water tube, conduit means communicating with said inlet means of said first water tube for conducting water from industrial equipment thereto, said water outlet means of said second water tube communicating with the interior of said container for discharging chilled water into said container, each of said coiled water and refrigerant tubes being formed of a material having high thermal conductivity and each of said first and second water tubes having a substantially smaller outside diameter than the inside diameter of the refrigerant tube extending thereabout, and pump means for pumping chilled water from said container to industrial equipment and for directing water from said equipment to said conduit means.

2. The system of claim 1 in which said refrigerant inlet means of each of said refrigerant tubes is provided with a separate thermostatically responsive expansion valve, each said thermostatically responsive expansion valve having sensing means responsive to the temperature of refrigerant as it flows through the refrigerant outlet means of the refrigerant tube with which each said expansion valve is associated.

3. The refrigeration system of claim 2 in which the ratio of the inner diameter of each refrigerant tube to the outer diameter of the water tube disposed therein is on the order of 2:1.

* * * * *